US007971952B2

(12) United States Patent
Furuhata

(10) Patent No.: US 7,971,952 B2
(45) Date of Patent: Jul. 5, 2011

(54) IMAGE RECORDING APPARATUS AND RECORDING MEDIUM CONVEYANCE METHOD EXECUTED BY IMAGE RECORDING APPARATUS

(75) Inventor: Tsuyoshi Furuhata, Tokyo (JP)

(73) Assignee: Olympus Corporation, Tokyo (JP)

( * ) Notice: Subject to any disclaimer, the term of this patent is extended or adjusted under 35 U.S.C. 154(b) by 606 days.

(21) Appl. No.: 12/012,979

(22) Filed: Feb. 6, 2008

(65) Prior Publication Data

US 2008/0204497 A1 Aug. 28, 2008

(30) Foreign Application Priority Data

Feb. 23, 2007 (JP) ..... 2007-044373

(51) Int. Cl.
*B41J 29/38* (2006.01)

(52) U.S. Cl. ..... 347/16; 347/19; 347/104

(58) Field of Classification Search ..... None
See application file for complete search history.

(56) References Cited

U.S. PATENT DOCUMENTS 4,935,786 A * 6/1990 Veeder ..... 399/401
2006/0072138 A1* 4/2006 Nakanishi et al. ..... 358/1.12
2008/0145123 A1* 6/2008 Kogure et al. ..... 399/395

FOREIGN PATENT DOCUMENTS

JP 2006-131415 A 5/2006

* cited by examiner

*Primary Examiner* — Matthew Luu
*Assistant Examiner* — Justin Seo
(74) *Attorney, Agent, or Firm* — Holtz, Holtz, Goodman & Chick, PC

(57) ABSTRACT

An image recording apparatus executes a recording process for a recording medium is fed from a feeding unit, or the recording medium for which the recording process has been executed and which is re-fed at least via a path switching unit after the recording process. The image recording apparatus comprises at least a driving control unit for deciding a page gap between preceding and succeeding recording medium on a conveyance path according to at least either of the recording medium is fed from the feeding unit and the recording medium for which the recording process has been executed and which is re-fed via the path switching unit after the recording process, and for issuing a control instruction to the path switching unit.

8 Claims, 11 Drawing Sheets

IMAGE RECORDING APPARATUS AND RECORDING MEDIUM CONVEYANCE METHOD EXECUTED BY IMAGE RECORDING APPARATUS

CROSS REFERENCE TO RELATED APPLICATIONS

This application claims benefit of Japanese Application No. 2007-044373 filed Feb. 23, 2007, the contents of which are incorporated by this reference.

BACKGROUND OF THE INVENTION

1. Field of the Invention

The present invention relates to an image recording apparatus that supports both-side recording, and more particularly, to a recording medium conveyance method executed by an image recording apparatus.

2. Description of the Related Art

For an image recording apparatus, a method for executing a recording process (data recording) on both sides of a recording medium is generally known.

For an image recording apparatus that supports both-side recording, a method for executing a recording process on the top side (a first face) of a recording medium with an image recoding unit, for re-feeding the recording medium to the image recording unit after conveying the recording medium toward a reversal path and reversing the recording medium to the back side (a second face), and for executing the recording process on the back side is known.

For example, an ink-jet color printer of a full line type is known as such an image recording apparatus. In the color printer of a full line type, recording heads, in each of which a plurality of nozzles for jetting an ink are formed in (cross feed direction) orthogonal to the conveyance direction of a recording medium, are arranged at intervals respectively for ink colors in the conveyance direction (feed direction).

In such an image recording apparatus (color printer), characters and images are recorded by feeding (supplying) and conveying a recording medium, by placing the recording medium, for which a recording process is to be executed, as opposed to a plurality of ink nozzles in each nozzle array (recording head), and by jetting inks of respective colors onto a recording medium being conveyed.

Additionally, since one image recording unit makes recording on the first and the second faces of a recording medium in such an image recording apparatus, the recoding medium is again conveyed to the image recording unit via a reversal path after the first face of the recording medium is recorded. In such an image recording apparatus, however, a succeeding recording medium can possibly collide with a preceding recording medium on a conveyance path unless timing at which a recording medium is conveyed when its first face is to be recorded, and timing at which the recording medium is conveyed when its second face is to be recorded by being re-fed are optimally controlled.

As a method for preventing this collision, a method for widely securing a distance (a page gap) between preceding and succeeding recording medium is known.

However, widely securing a page gap reduces the number of sheets recorded per unit time of an image recording apparatus, leading to degradation in a throughput.

For example, Patent Document 1 (Japanese Published Unexamined Patent Application No. 2006-131415) discloses a method for deciding the supply timing of a succeeding recording medium by making scheduling for satisfying all of first, second and third conditions to be descried below as a technique for setting a page gap.

the first condition: The conveyance start timing of a recording medium (A) to be fed to an image recording unit in order to make recording on the first face of the recording medium, and the conveyance start timing of a recording medium (B) to be re-fed to the image recording unit in order to make recording on the second face are decided when the front edge of the recording medium B reaches a collection unit while maintaining a page gap upon completion of the passage of the recording medium A.

the second condition: The supply timing is decided when the front edge of a succeeding recording medium reaches a supply position while maintaining a page gap of a predetermined amount or more at the timing when the preceding and the succeeding recording medium do not exist at the same time in the supply position of a recording medium on a more upstream side than an image recording unit for executing a recording process for a recording medium, and the rear edge of the preceding recording medium has passed.

the third condition: The supply timing is decided when the front edge of a succeeding recording medium reaches a reversal position while maintaining a page gap of a predetermined amount or more at the timing when the preceding and the succeeding recording medium do not exist at the same time in the reversal position in a path switching unit, and the rear edge of the preceding recording medium has passed.

According to Patent Document 1, an image recording apparatus for setting a required minimum page gap of a succeeding recording medium 43*b* from a preceding recording medium 43*a*, and for executing a continuous recording process with nozzle arrays (recording heads) 41 is realized.

However, with the scheduling method according to Patent Document 1, a path switching unit 42 is controlled by making switching with a page gap in each of a both-side continuous recording process, and a both-side/one-side continuous recording process.

Here, the page gap of Patent Document 1 is described with reference to FIG. 1.

FIG. 1A shows the conveyance of recording medium at the time of one-side continuous recording, whereas FIGS. 1B and 1C show the conveyance of recording medium at the time of both-side continuous recording or at the time of one-side/both-side continuous recording.

For the page gap of Patent Document 1, a page gap at the time of one-side recording is assumed to be t, and a page gap at the time of both-side continuous recording and at the time of both-side/one-side continuous recording is assumed to be $t+\alpha$. Additionally, the succeeding recording medium 43*b* is conveyed after the preceding recording medium 43*a* by widening the distance by the page gap of $\alpha$ at the time of both-side continuous recording and at the time of both-side/one-side continuous recording. The reason why the distance is widened by the page gap of $\alpha$ is that the page gap must be secured by an excess of $\alpha$ since a process for moving the path switching unit 42 by h during a transition from FIG. 1B to FIG. 1C at the time of both-side continuous recording or at the time of both-side/one-side continuous recording.

Therefore, the page gap becomes wide by $\alpha$ at the time of both-side recording or at the time of both-side/one-side recording in comparison with a page gap at the time of one-side recording.

SUMMARY OF THE INVENTION

An image recording apparatus according to one preferred embodiment is an image recording apparatus for executing a recording process for a recording medium fed from a feeding unit, or a recording medium, for which the recording process has been executed and which is re-fed at least via a path switching unit after the recording process. This apparatus comprises at least a driving control unit for deciding a page gap between preceding and succeeding recording medium on a conveyance path according to at least either of the recording medium fed from the feeding unit, and the recording medium for which the recording process has been executed and which is re-fed via the path switching unit after the recording process, based on at least information specifying the type of the recording medium, and for issuing a control instruction to the path switching unit.

A recording method conveyance method according to another preferred embodiment is a recording medium conveyance method executed by an image recording apparatus for executing a recording process for a recording medium fed from a feeding unit, or the recording medium, for which the recording process has been executed and which is re-fed at least via a path switching unit after the recording process, comprising: deciding a page gap between preceding and succeeding recording medium on a conveyance path according to at least either of the recording medium fed from the feeding unit, and the recording medium, for which the recording process has been executed and which is re-fed via the path switching unit after the recording process, based on at least information specifying the type of the recording medium, and conveying the preceding and the succeeding recording medium based on the decided page gap and issuing a control instruction to the path switching unit based on at least the information specifying the type of the recording medium.

DESCRIPTION OF THE PREFERRED EMBODIMENTS

Preferred embodiments according to the present invention are described in detail below with reference to the drawings.

Figure 1A:
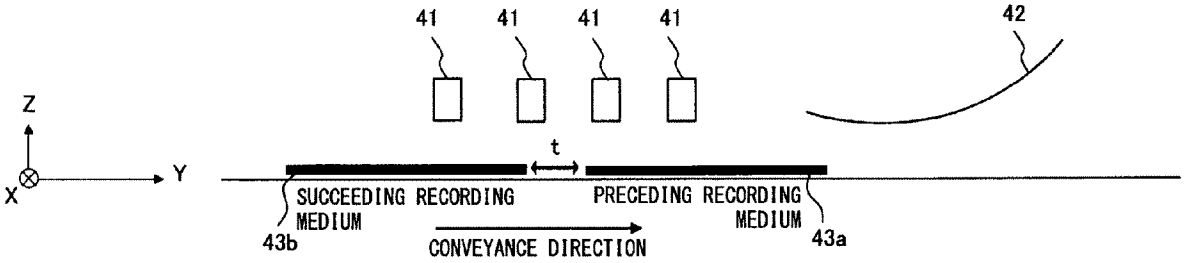
FIG. 1A is a diagram showing the conveyance of recording medium according to Patent Document 1 at the time of one-side continuous recording.
Figure 1B:
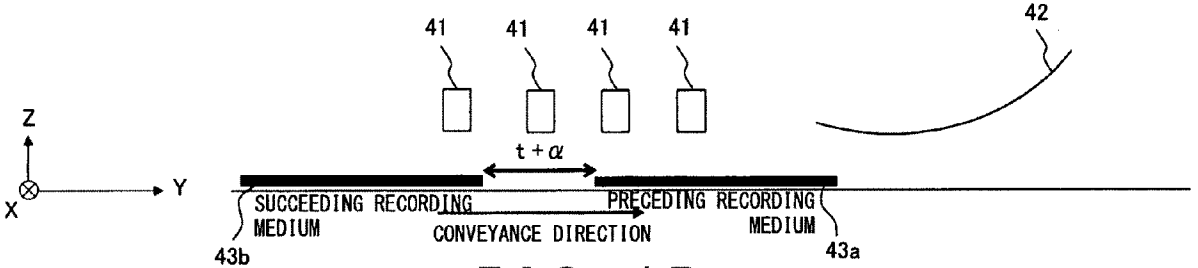
FIGS. 1B and 1C are diagrams showing the conveyance of the recording medium according to Patent Document 1 at the time of both-side continuous recording or at the time of one-side/both-side continuous recording.
Figure 1C:
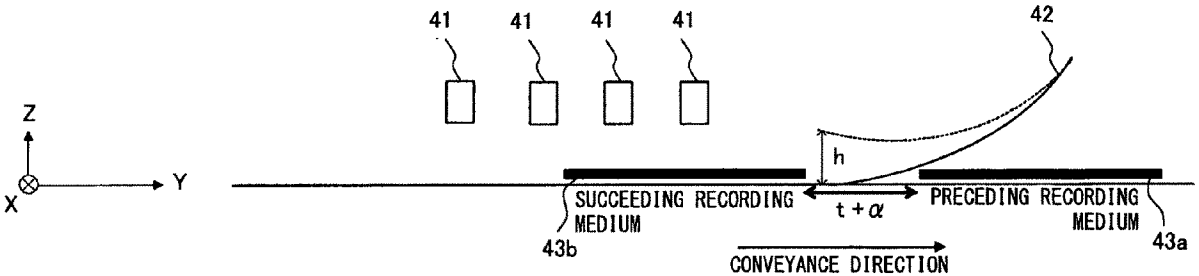
Figure 2:
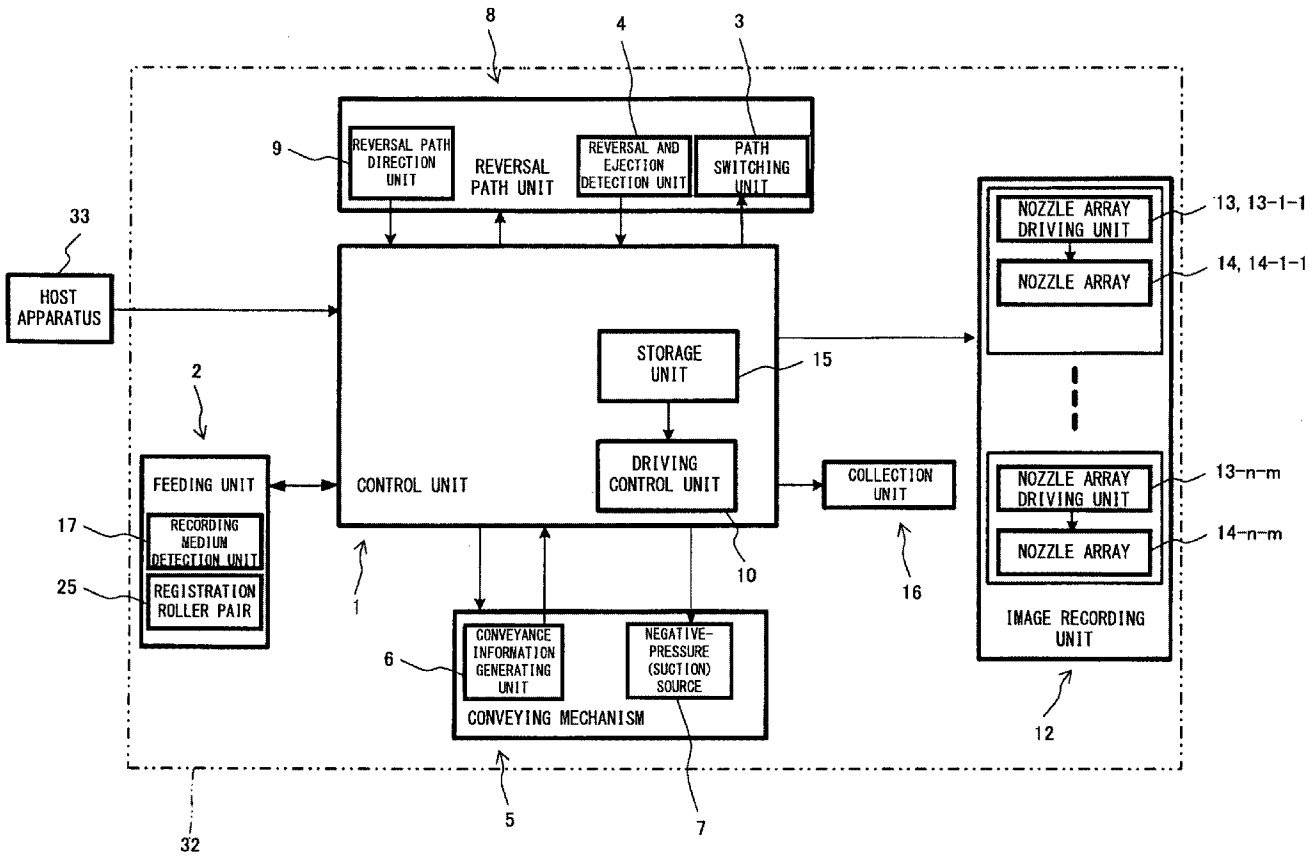
FIG. 2 is a conceptual block diagram showing an image recording apparatus in a preferred embodiment.

FIG. 2 is a conceptual block diagram showing an image recording apparatus in a preferred embodiment.

Figure 3:
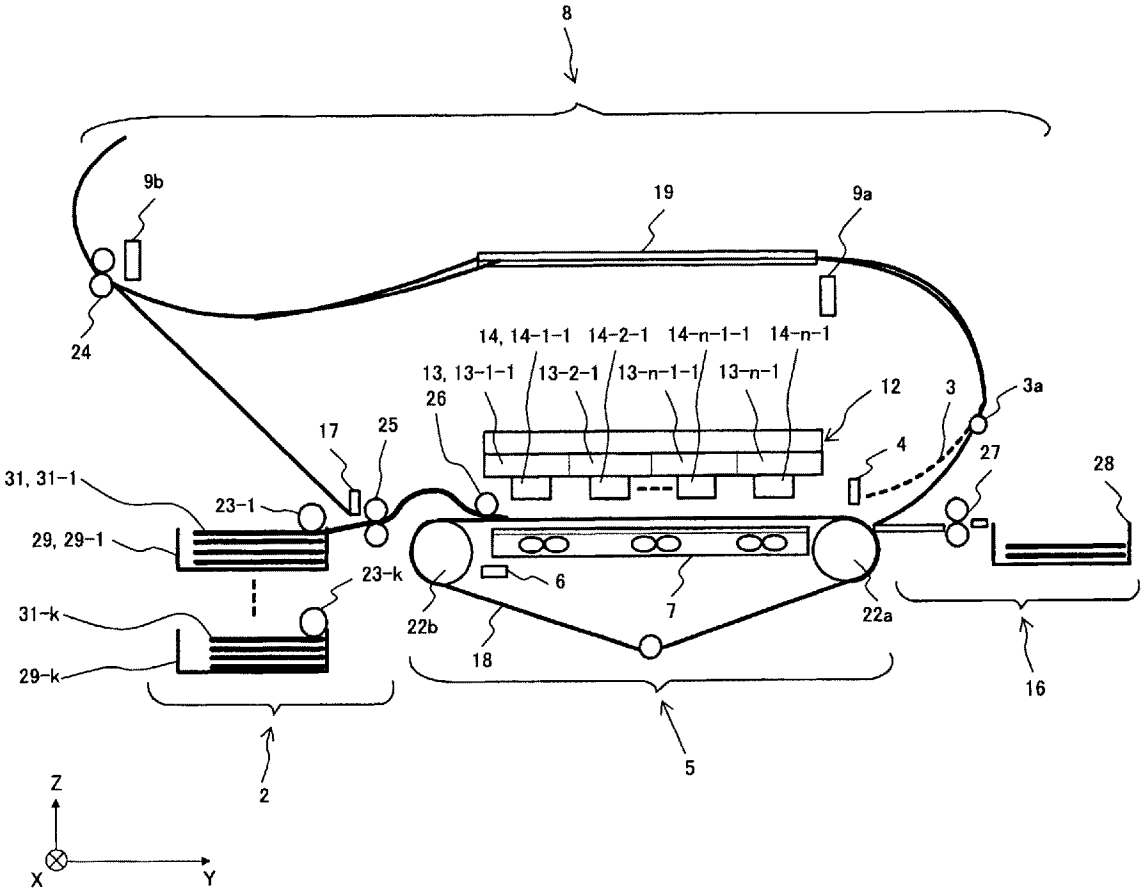
FIG. 3 is a diagram showing an example of an arrangement of constituent elements of the image recording apparatus in the preferred embodiment.

Additionally, FIG. 3 is a diagram showing an example of an arrangement of constituent elements of the image recording apparatus in this preferred embodiment.

In the following description, a direction (cross feed direction) orthogonal to the conveyance direction of a recording medium, the conveyance direction (feed direction) of the recoding medium, and a direction orthogonal to an XY plane are assumed to be an X-direction or the width direction of the recording medium, a Y direction, and a Z direction, respectively.

An example of a configuration of an image recording apparatus according to the present embodiment is described first.

The image recording apparatus 32 according to the preferred embodiment comprises at least a control unit 1 for controlling the entire image recording apparatus 32, a feeding unit 2 for feeding recording medium 31 (31-1 to 31-k) to a conveying mechanism 5, the conveying mechanism 5 for conveying the recording medium 31 passed from the feeding unit 2 to an image recording unit 12, a reversal path unit 8 for reversing the side of a recording medium 31 and for re-feeding the recording medium 31 to the image recording unit 12 at the time of both-side recording, the image recording unit 12 for executing a recording process for a recording medium 31, and a collection unit 16 for collecting a recording medium 31 for which the recording process has been executed.

The control unit 1 comprises at least a processing circuit composed of a MPU (Micro Processor Unit) of processing unit having, for example, a control function and an computation function, a ROM (Read Only Memory) for storing a control program, a RAM (Random Access Memory) that serves as a working memory of the MPU, and the like, and a nonvolatile memory for storing setting values, etc. for the control of the image recording apparatus 32.

In a preferred embodiment of the image recording apparatus according to the present invention, the control unit 1, which includes, for example, a driving control unit 10, has at least the processing unit, and a configuration for storing a control program. The processing unit is made to execute this control program, whereby the control program serves as the driving control unit 10. This control program is stored in the above described ROM or a storage unit 15. The storage unit 15 is configured, for example, with a nonvolatile memory.

Additionally, the control unit 1 may be configured to further comprise, for example, a signal processing circuit. The signal processing circuit is controlled with the control program executed by the processing unit of the control unit 1, whereby the signal processing circuit may serve as the driving control unit 10.

The feeding unit 2 is provided on the most upstream side of a conveyance path of a recording medium 31. Once the recording process is started, the feeding unit 2 conveys the stored recording medium 31 one by one to the downstream side of the conveyance path.

The feeding unit 2 is composed of storage cassettes 29 (29-1 to 29-k), pickup rollers 23 (23-1 to 23-k), a recording medium detection unit 17, and registration roller pair 25.

At least one or more storage cassettes 29 are comprised to store the recording medium 31 the type (the material, the length (the size, the vertical/horizontal orientation), the thickness, the width, the frictional coefficient, etc.) of which is different. One pickup roller 23 is comprised for each of the storage cassettes 29. Each pickup roller 23 touches the topmost recording medium 31, which is stored in a storage cassette 29, picks up the recording medium 31 one by one, and sends each of the recording medium 31 to the conveyance path. The recording medium detection unit 17 detects each of the recording medium 31 picked up by each pickup roller 23, and notifies the control unit 1. The registration roller pair 25 are controlled by the control unit 1 based on information that a recording medium 31 is detected by the recording medium detection unit 17. The registration roller pair 25 hold the recording medium 31 in between while correcting the skew of the recording medium 31 being conveyed, and pass the recording medium 31 to the conveying mechanism 5.

The conveying mechanism 5 is composed of a driving roller 22*a*, a conveyance element 18, a driven roller 22*b*, a conveyance information generating unit 6, a negative-pressure (suction) source 7, and a touching roller 26. A conveyance face implemented by the conveyance element 18 is provided as opposed to the ink-jet holes of a plurality of nozzle arrays 14 (14-1-1 to 14-n-m).

The conveyance element 18 is bridged across the driving roller 22*a* and the driven roller 22*b*. The conveyance element 18 moves rotationally by driving the driving roller 22*a* according to an instruction of the control unit 1, and holds the recording medium 31, which is passed from the feeding unit 2, between the touching roller 26 and the conveyance element 18 itself. Thereafter, the recording medium 31 starts to be conveyed while being sucked to the conveyance element 18 by the negative-pressure (suction) source 7. For the driven roller 22*b*, by way of example, a rotary encoder in the conveyance information generating unit 6 is provided. The rotary encoder generates a pulse signal corresponding to the distance (the amount of move) of the conveyance element 18, and notifies the control unit 1.

The reversal path unit 8 is composed of a path switching unit 3, a path switching unit driving roller 3*a*, a reversal and ejection detection unit 4, a conveyance path 19, reversal path detection units 9*a* and 9*b*, and a reversal roller pair 24.

When a notification of recording on the second face is made to the control unit 1 with job information, the path switching unit 3 is switched by driving the path switching unit driving roller 3*a* at set timing based on information detected by the reversal and ejection detection unit 4, and a recording medium 31 is guided to the upstream side of the reversal path unit 8.

The plurality of reversal path detection units 9*a* and 9*b* on the reversal path unit 8 detect the passage state of the recording medium 31, reverse the side of the recording medium 31 by causing the reversal roller pair 24 to hold the recording medium 31 in between, and re-feed the recording medium 31 to the upstream side of the conveying mechanism 5.

The image recording unit 12 is provided to be of length exceeding the maximum width of a recording medium in design. The image recording unit 12 is composed of the plurality of nozzle arrays (recording heads) 14 (14-1-1 to 14-n-m) for jetting inks, and nozzle array driving units 13 (13-1-1 to 13-n-m), which are provided respectively for the nozzle arrays (recording heads) 14, for outputting a driving signal to instruct each of the nozzle arrays (recording heads) 14 to jet an ink based on an instruction of the control unit 1.

The nozzle array driving units 13 execute a recording process for image data of one line, which is output from the control unit 1, by controlling the nozzle arrays 14. The nozzle arrays (recording heads) 14-1-1 to 14-n-m are provided to be of length exceeding a maximum recording width by arranging n (n is an integer of $2 \leqq n$) short nozzle arrays, and provided in parallel for inks of m (m is an integer of $2 \leqq m$) colors. The nozzle arrays (recording heads) 14-1-1 to 14-n-m jet the inks of m colors onto the recording medium 31 based on driving signals from the nozzle array driving units 13-1-1 to 13-n-m, which are provided respectively for the nozzle arrays (recording heads) 14-1-1 to 14-n-m.

The collection unit 16 is composed of an ejection roller pair 27 and a collection tray 28.

A recording medium 31 for which the recording process has been executed is held in between by the ejection roller pair 27, which is provided on a more downstream side than the path switching unit 3, and collected by the collection tray 28.

A host apparatus 33 is connected as an external appliance of the image recording apparatus 32 according to the present embodiment, for example, via a LAN or the like. This host apparatus 33 is equivalent to a computer of a user who causes the image recording apparatus 32 according to the present embodiment to execute the recording process, and notifies the image recording apparatus 32 according to the present embodiment of job information as information about the recording process.

The job information in user specification information notified from the host apparatus 33 includes image data, a material instruction (information about the friction of each material is prestored), a thickness instruction, a shape instruction, and a size instruction (a length and a vertical/horizontal orientation) as information specifying the type of a recording medium, the number of sheets to be recorded, and a one-side recording instruction, a both-side recording instruction, etc. as information specifying the mode of the recording process.

The control unit 1 notifies the image recording unit 12 of image data of 1 line to n lines (n is an integer of $2 \leqq n$) stored, for example, in the above described RAM, and causes the image recording unit 12 to execute the recording process.

If the driving control unit 10 is, for example, a program stored in the ROM of the control unit 1, the processing unit of the control unit 1 controls the pickup rollers 23-1 to 23-k, and the registration roller pair 25 in order to feed a preceding recording medium 31 while maintaining a page gap set for a succeeding recording medium 31, and switches the path switching unit 3 at set path switching timing with the operational process of the program.

On the other hand, the storage unit 15 stores the feed timing of the feeding unit 2 for generating a page gap, or the re-feed timing when a recording medium 31 is re-fed by the reversal path unit 8 after via the path switching unit 3, and path switching timing in information used to control the path switching unit 3 by making a correspondence with the type of the recording medium 31.

The processing unit of the control unit 1 causes a preceding recording medium 31 to be fed while maintaining a page gap set for a succeeding recording medium 31, and causes the path switching unit 3 to make path switching respectively at the feed timing or the re-feed timing, and at the path switching timing, which are read from the storage unit 15, according to a program instruction from the driving control unit 10.

Additionally, in the storage unit 15 of the control unit 1, separation distances from the position of a recording medium 31, which is detected by the recording medium detection unit 17, to the nozzle arrays 14-1-1 to 14-n-m are prestored as information about the design/specifications of the image recording apparatus 32 according to the present embodiment by being converted into the cumulative value of the pulse signal of the above described rotary encoder in the conveyance information generating unit 6.

The control unit 1 drives corresponding nozzle array driving units 13-1-1 to 13-n-m at the timing when the cumulative value of the pulse signal, which is generated by the rotary encoder in the conveyance information generating unit 6 after the front edge of the recording medium 31 in the conveyance direction is detected, and the cumulative value of the above described pulse signal prestored in the storage unit 15 match, and executes the recording process by causing the nozzle arrays 14-1-1 to 14-n-m to jet the inks onto the recording medium 31.

Upon receipt of a notification to start the recording process along with the job information from the host apparatus 33, the control unit 1 selects one of the storage cassettes 29-1 to 29-k based on the size, the vertical/horizontal orientation, and the type of a recoding medium, which are specified in the job information, and conveys recording medium 31 one by one from the feeding unit 2 to the conveying mechanism 5 while maintaining a page gap defined based on the size, the vertical/horizontal orientation, and the type of the recording medium. The defined page gap will be described in detail later.

If the job information notified from the host apparatus 33 instructs both-side recording, the control unit 1 receives a detection signal when the reversal and ejection detection unit 4 detects the front edge of the recording medium 31. The control unit 1 performs a control to switch the path switching unit 3 to either of the side of the collection unit 16 (a first conveyance path) and the side of the reversal path unit 8 (a second conveyance path) based on the job information notified from the host apparatus 33, and to guide the recording medium 31 to the switched side.

A recording medium 31 guided to the side of the first conveyance path is collected in the collection tray 28 by the ejection roller pair 27. In contrast, a recording medium 31 guided to the side of the second conveyance path goes up along the path switching unit 3, and is again guided to the upstream side of the conveying mechanism 5.

A recording medium conveyance method executed by the image recording apparatus according to the first preferred embodiment is described next with reference to FIG. 4.

Figure 4A:
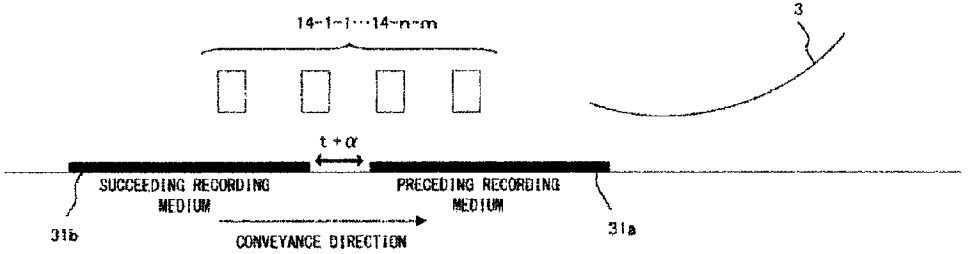
FIGS. 4A and 4B are diagrams explaining a recording medium conveyance method executed by an image recording apparatus according to a first preferred embodiment.
Figure 4B:
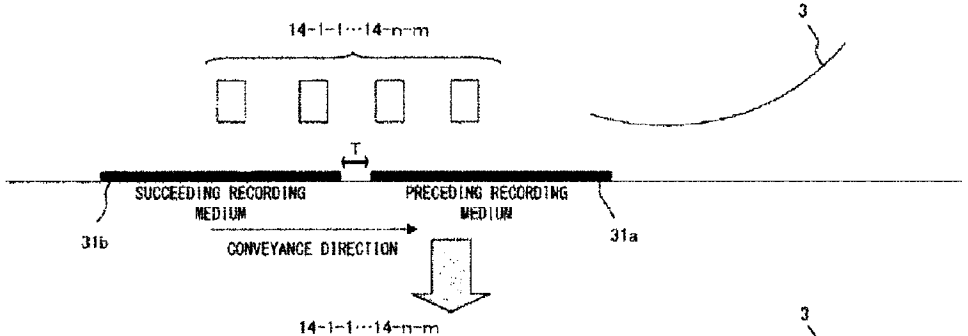
Figure 4B:
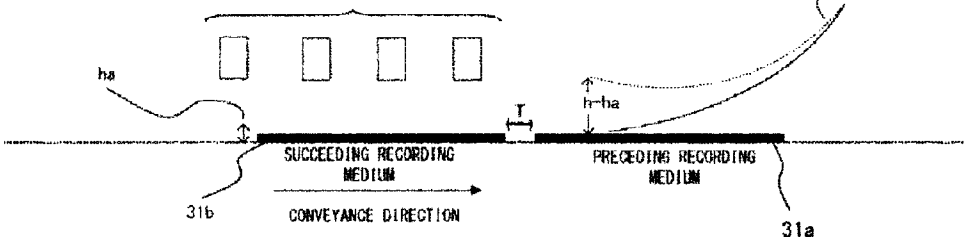

FIG. 4 shows page gaps at the time of both-side continuous recording and at the time of one-side/both-side continuous recording.

The first preferred embodiment assumes a case where an ink used in the recording process has a quickly drying nature, or a case where a distance (time) sufficient to make an ink established on the conveyance path of a recording medium is secured.

Additionally, in the description provided with reference to this figure, it is assumed that a defined page gap when one-side recording is continuously made (one-side continuous recording) is t, an excess of a distance secured to prevent the path switching unit 3 from touching the recording medium 31 when the path switching unit 3 is switched during a page gap of t is $\alpha$, a first defined page gap when both-side recording is continuously made (both-side continuous recording) and when one-side recording and both-side recording are alternately made (one-side/both-side continuous recording) is $t+\alpha$, a second defined page gap is T, the thickness of the recording medium 31 is ha, a separation distance from the nozzle arrays (recording heads) 14 to the conveyance face implemented by the conveying mechanism 5 is h, a distance, which varies with the floating of a recording medium 31, from the nozzle arrays (recording heads) 14 to the recording medium 31 is hb, and $t+\alpha>=T$.

With the image recording apparatus 32 according to the first preferred embodiment, at the time of both-side continuous recording or at the time of one-side/both-side continuous recording, the recording medium 31 are fed to the conveying mechanism 5 while the first defined page gap $t+\alpha$ is being maintained as shown in FIG. 4A, or the recording medium 31 are fed to the conveying mechanism 5 so that the second defined page gap T, which is smaller than the first defined page gap $t+\alpha$, is maintained as shown in FIG. 4B.

In the case of the first defined page gap $t+\alpha$, the preceding recording medium 31*a* does not touch the path switching unit 3 because the page gap is large and switching by the path switching unit 3 is made after the preceding recording medium 31*a* completely passed under the path switching unit 3. However, in the case of the second defined page gap T, the preceding recording medium 31*a* touches the path switching unit 3 because the page gap is small and switching by the path switching unit 3 is made before the preceding recording medium 31*a* completely passes under the path switching unit 3.

In the image recording apparatus 32 according to the first preferred embodiment, switching is made between the first defined page gap $t+\alpha$, which is similar to that in a conventional image recording apparatus, and the second defined page gap T, which is smaller than the first defined page gap, depending on the size, the vertical/horizontal orientation, and the type of a recording medium 31 to be conveyed at the time of both-side continuous recording or at the time of one-side/both-side continuous recording. As a result, the page gap at the time of both-side continuous recording or at the time of one-side/both-side continuous recording is shortened in the image recording apparatus 32 according to the first preferred embodiment.

A pattern (pattern 1) of conveying the preceding recording medium 31*a* and the succeeding recording medium 31*b* respectively to the conveyance path (the first conveyance path) to the collection unit 16, and the path (the second conveyance path) to the reversal path unit 8 with the second defined page gap T is described next with reference to FIGS. 5 and 6.

The pattern 1 causes the following problem if the recording medium 31 are conveyed with the second defined page gap T.

Figure 5:
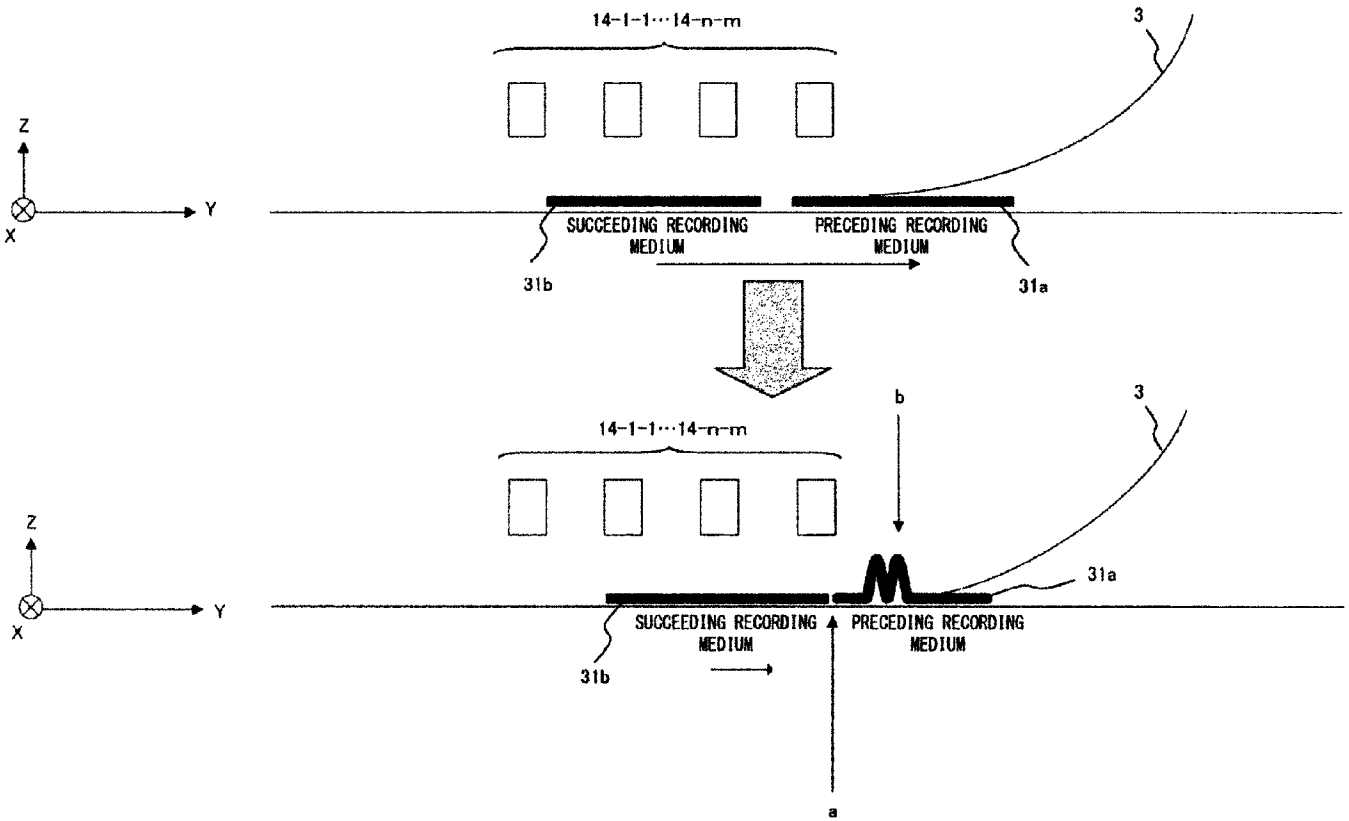
FIG. 5 is a diagram (No. 1) explaining a pattern of conveying preceding and succeeding recording medium respectively to first and second paths with a second defined page gap T.

With the pattern 1, as shown in FIG. 5, the preceding recording medium 31*a* and the path switching unit 3 touch at a point b because switching by the path switching unit 3 is made while the preceding recording medium 31*a* is passing, if the page gap is set to the shorter second defined page gap T. As a result, the preceding medium 31*a* gets stuck depending on the type (the material, the length (the size, the vertical/horizontal orientation), and the thickness) of a recording medium 31, and the succeeding recording medium 31*b* collides with (touches) the preceding recording medium 31*a* at a point a, so that the recording medium 31 can jam on the conveyance path of the recording medium 31.

Figure 6:
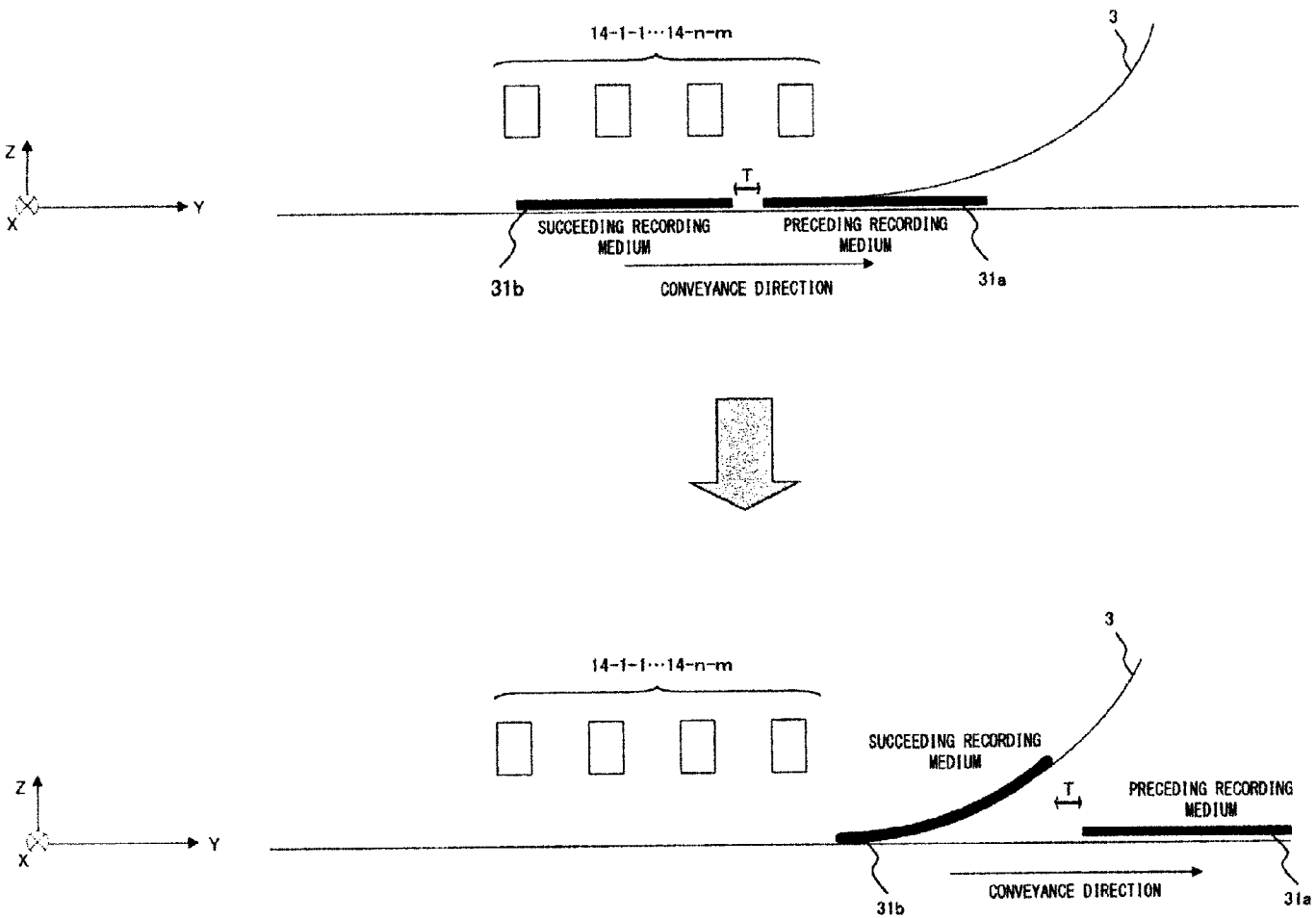
FIG. 6 is a diagram (No. 2) explaining the pattern of conveying the preceding and the succeeding recording medium respectively to the first and the second paths with the second defined page gap T.

Therefore, in the image recording apparatus 32 according to the first preferred embodiment, a page gap is shortened to the second defined page gap T only if a recording medium 31 to be conveyed is determined to be conveyable with the second defined page gap T in the pattern 1 as shown in FIG. 6.

In the image recording apparatus 32 according to the first preferred embodiment, the page gap is set not to the second defined page gap T but to the longer first defined page gap t+α, if the frictional coefficient of a recording medium 31 is relatively large, for example, if the recording medium 31 is coarse paper, an envelope, etc.

In the image recording apparatus 32 according to the first preferred embodiment, a conveyance time is reduced by conveying the recording medium 31 with the second defined page gap T as shown in FIG. 6, if the frictional coefficient of a recording medium 31 is relatively small and the recording medium 31 does not get stuck when touching the path switching unit 3. In the image recording apparatus 32 according to the first preferred embodiment, when the control unit 1 controls the path switching unit 3, switching is made at path switching timing, which is made to correspond to specification information of the job information (the type of the recording medium 31), while the preceding recording medium 31*a* is passing under the path switching unit 3 after the reversal and ejection detection unit 4 detects the preceding recording medium 31*a*.

As described above, the image recording apparatus 32 according to the first preferred embodiment improves the throughput of the continuous recording process by setting and shortening the page gap between the preceding recording medium 31*a* and the succeeding recording medium 31*b* to the second defined page gap T, if the succeeding recording medium 31*b* is conveyed to the upstream side of the reversal path unit 8 with the pattern 1, and if the frictional coefficient of the preceding recording medium 31*a* is relatively small, and does not get stuck when touching the path switching unit 3.

A pattern (pattern 2) of conveying the preceding recording medium 31*a* and the succeeding recording medium 31*b* respectively to the path (the second conveyance path) to the reversal path unit 8, and the path (the first conveyance path) to the collection unit 16 with the second defined page gap is described next with reference to FIGS. 7 and 8.

Figure 7:
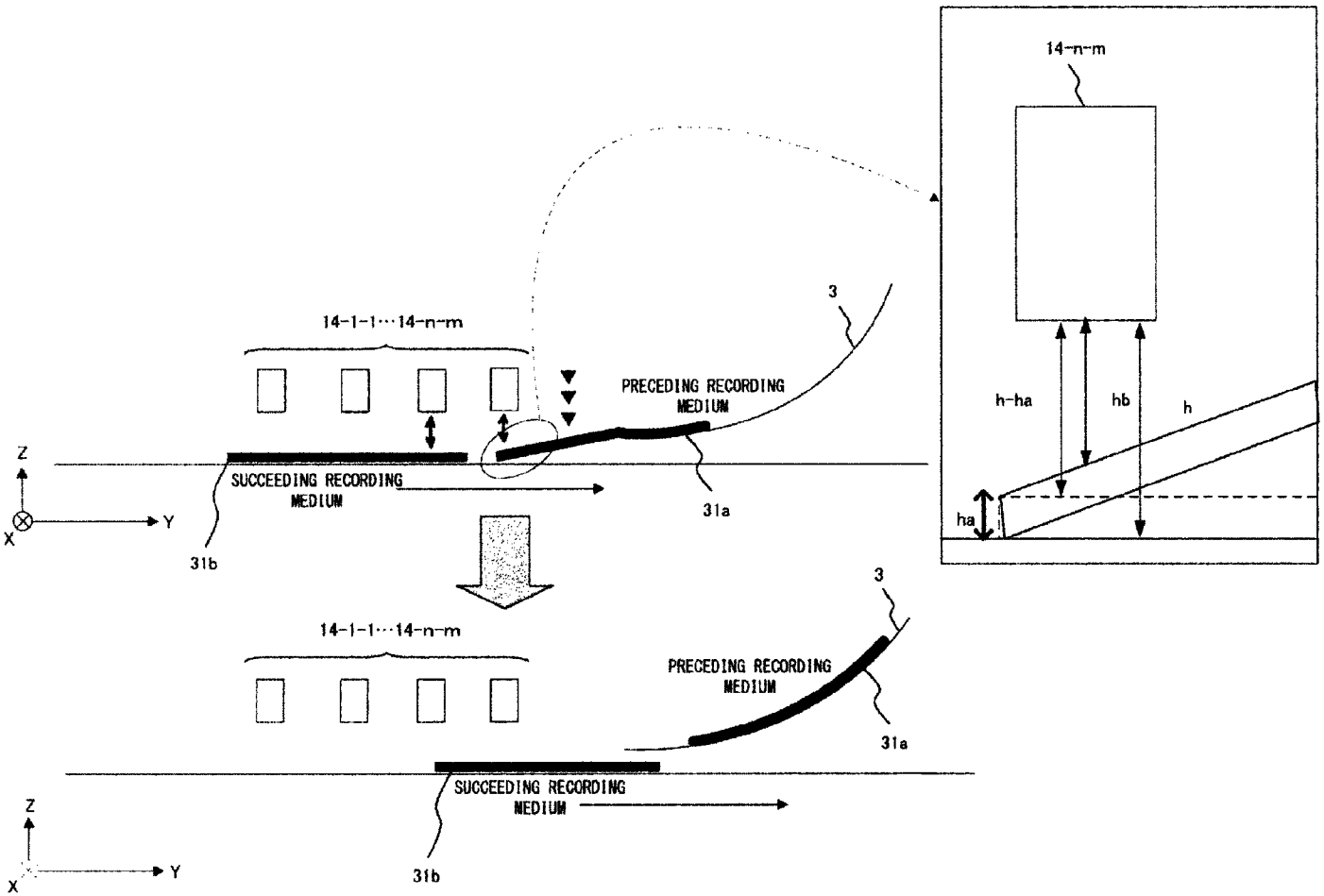
FIG. 7 is a diagram (No. 1) explaining a pattern of conveying preceding and succeeding recording medium respectively to second and first paths with the second defined page gap T.

As shown in FIG. 7, if switching by the path switching unit 3 is made while the preceding recording medium 31*a* is transferring to the path switching unit 3, the rear edge of the preceding recording medium 31*a* floats depending on the type (the material, the length (vertical/horizontal orientation, the size), and the thickness) of a recording medium also in the case of the pattern 2. Therefore, a distance h-ha when an ink is jetted from the nozzle array (recording head) 14-n-m and the recording process is executed for the recording medium 31*a* is reduced to a distance hb, and ill effects can be possibly produced on the recoding process.

Figure 8:
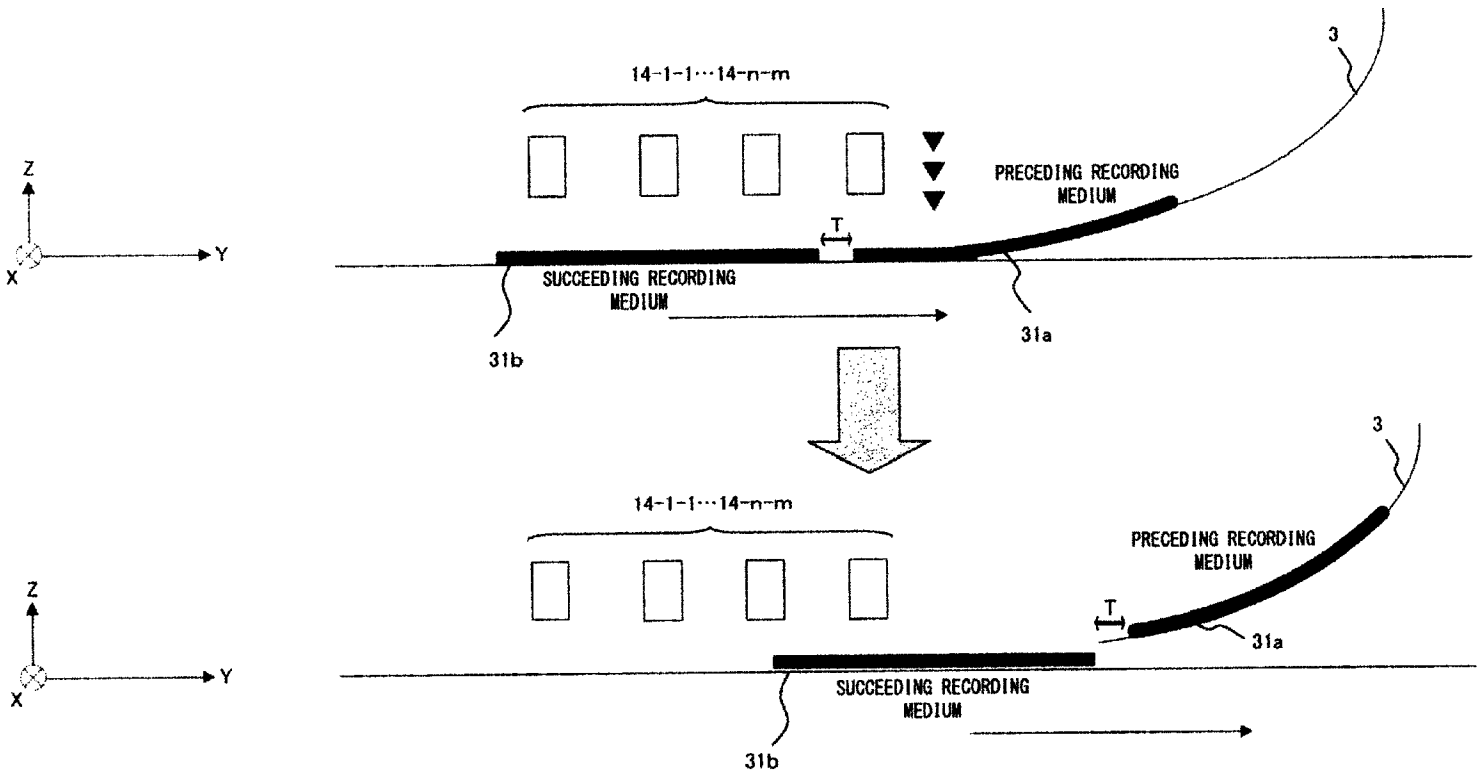
FIG. 8 is a diagram (No. 2) explaining the pattern of conveying the preceding and the succeeding recording medium respectively to the second and the first paths with the second defined page gap T.

Accordingly, the image recording apparatus 32 according to the first preferred embodiment shortens the page gap to the second defined page gap T only if a recording medium 31 to be conveyed is determined to be conveyable with the second defined page gap T also in the pattern 2, as shown in FIG. 8.

The image recording apparatus 32 according to the first preferred embodiment shortens the page gap to the second defined page gap T if the preceding recording medium 31*a* to be conveyed is determined not to float with the second defined page gap T, or sets the page gap to the first defined page gap t+α if the preceding recording medium 31*a* to be conveyed is determined to float with the second defined page gap T.

In the image recording apparatus 32 according to the first preferred embodiment, switching is made at the path switching timing, which is made to correspond to the specification information of the job information (the type of a recording medium 31), when the control unit 1 controls the path switching unit 3 while the preceding recording medium 31*a* is being conveyed to the path (the second conveyance path) to the reversal path unit 8.

The job information that is determined to cause floating is information specifying a relatively hard recording medium 31 such as a card board, thick paper, etc., as the recording medium 31 to be recorded, or information specifying the horizontal recording of a recording medium 31, the length of which in the conveyance direction is short in size specification, for the recording medium 31 to be recorded. The reason why the recording medium 31 to be horizontally recorded is included is that the amount of downward warping by the self-weight of the recording medium 31 reduces as the length in the conveyance direction decreases, which leads to an increase in the possibility of the above described distance hb.

As stated earlier, the image recording apparatus 32 according to the first preferred embodiment improves the throughput of the continuous recording process by setting and shortening the page gap between the preceding recording medium 31*a* and the succeeding recording medium 31*b* to the second defined page gap T, if the preceding recording medium 31*a* is conveyed to the upstream side of the reversal path unit 8, and the rear edge of the preceding recording medium 31*a* does not float with the pattern 2.

Figure 9:
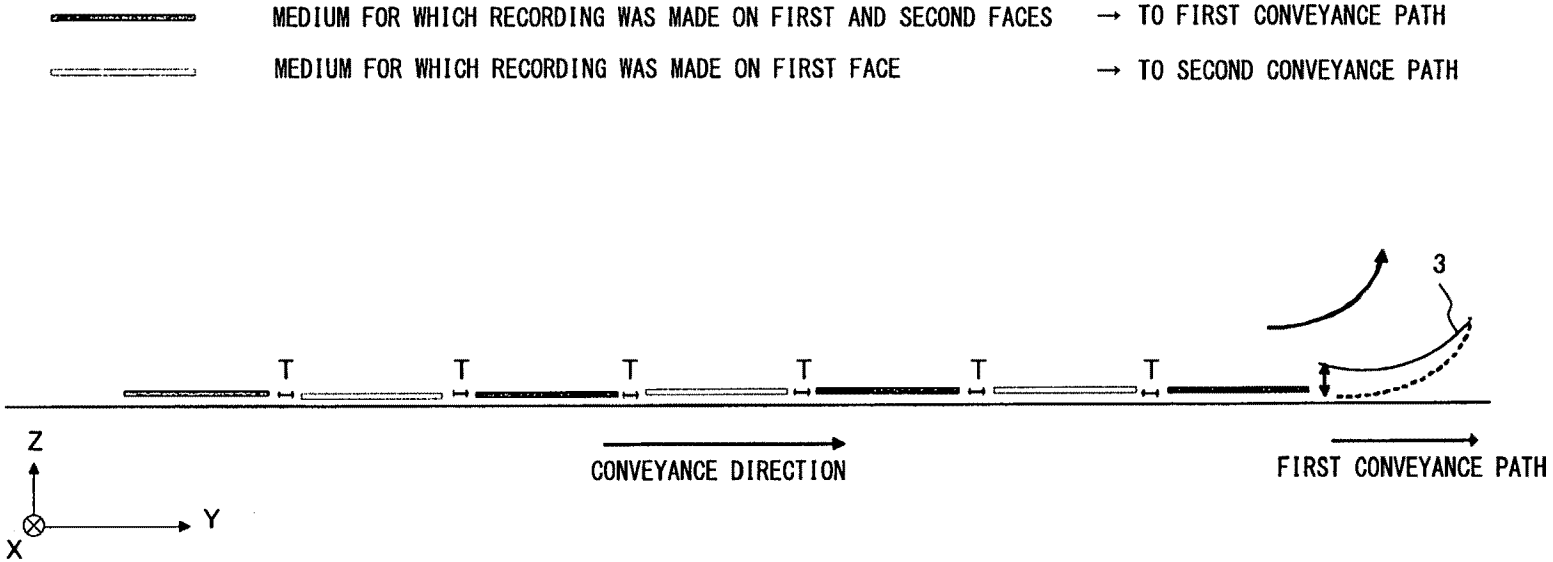
FIG. 9 is a diagram showing a state in which recording medium are conveyed by setting a page gap to the second defined page gap T with a method according to a first preferred embodiment.

FIG. 9 shows a state where the recording medium 31 are conveyed by setting the page gap to the second defined page gap T in the image recording apparatus according to the first preferred embodiment. In this figure, the recording process is executed for recording medium 31 for which the recording process has been executed on their first and second faces, and recording medium 31 for which the recording process has been executed on their first face, while the second defined page gap T is being maintained.

Figure 10:
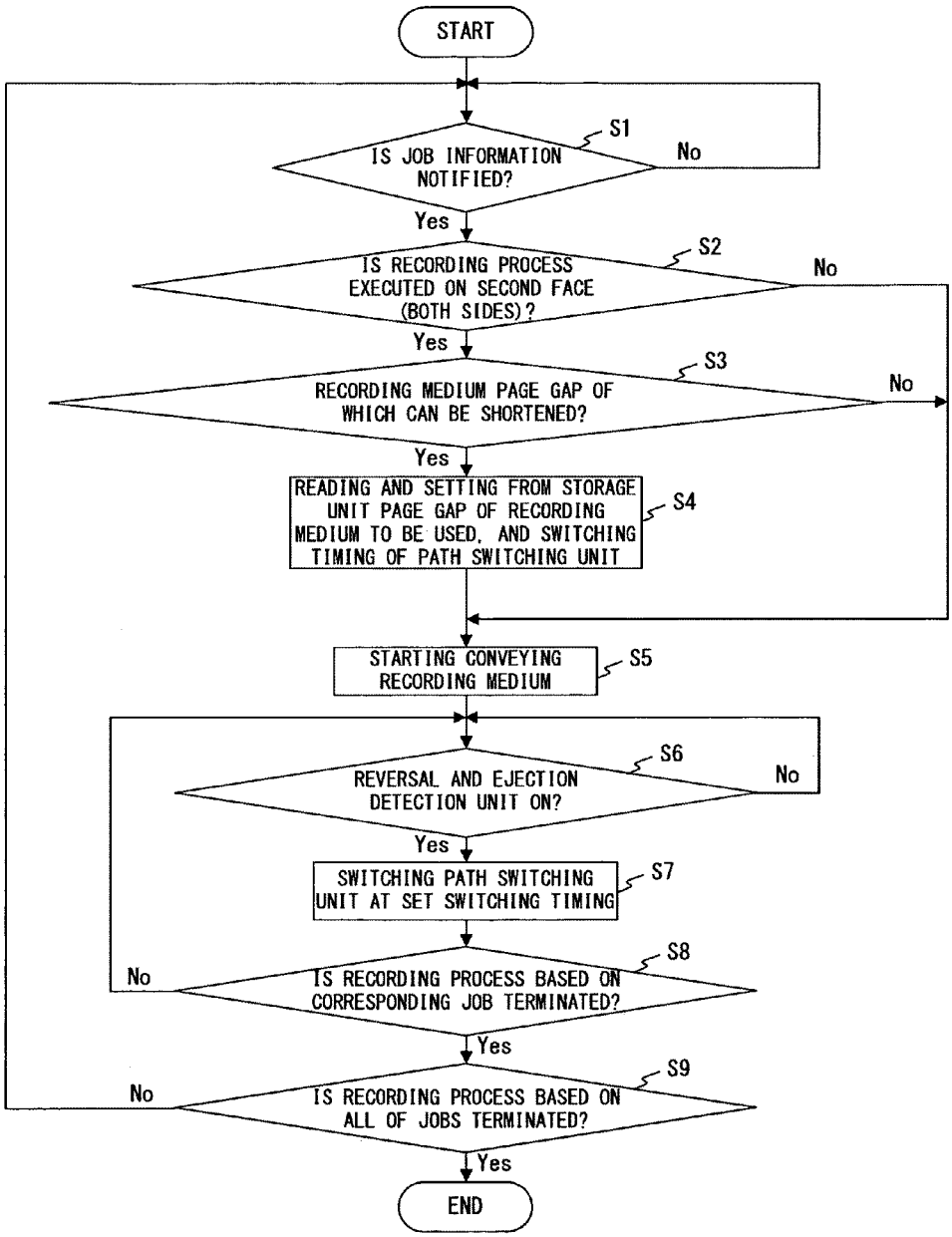
FIG. 10 is a flowchart showing the operational process of a driving control unit within a control unit in the image recording apparatus according to the first preferred embodiment.

FIG. 10 is a flowchart showing the operational process of the driving control unit 10 within the control unit 1 of the image recording apparatus according to the first preferred embodiment.

If the driving control unit 10 is configured with a signal processing circuit, this process shown in FIG. 10 is implemented in a way such that the processing unit (MPU) of the control unit 1 controls the signal processing circuit. Or, if the driving control unit 10 is configured with a program, this process is implemented in a way such that the processing unit (MPU) executes the program stored in the ROM of the control unit 1.

In this figure, the control unit 1 determines in step S1 whether or not job information is notified from the host apparatus 33. If the job information is determined not to be notified ("NO" in step S1), the process is returned to step S1, in which the job information is waited to be notified.

If the job information is determined to be notified from the host apparatus 33 in step S1 ("YES" in step S1), the control unit 1 determines based on the job information in step S2 whether or not a recording process is both-side recording (recording that requires path switching by the path switching unit 3) for making recording also on the second face. If the control unit 1 determines the recording process to be not both-side recording but one-side recording ("NO" in step S2), the process is moved to step S5.

Next, the control unit 1 determines in step S3 whether or not the recording medium 31 is a recording medium 31 the page gap of which can be shortened to the second defined page gap T, if the recording process is determined to be both-side recording ("YES" in step S2). This determination is made based on the type (the material, the thickness, the frictional coefficient, etc.) of the recording medium within the job information.

If the control unit 1 determines that the page gap cannot be shortened to the second defined page gap T ("NO" in step S3) as a result of the determination made in step S3, the process is moved to step S5 without changing the width of the page gap. Or, if the control unit 1 determines that the page gap can be shortened ("YES" in step S3), the process is moved to step S4, in which the control unit 1 reads and sets from the storage unit 15 the feed timing or the re-feed timing for setting the page gap, which is made to correspond to the type of the specified recording medium 31, and the switching timing of the path switching unit 3.

When the page gap is decided with the processes of steps S3 and S4, the process is moved to step S5, in which the control unit 1 starts conveying the recording medium 31 so that the page gap set in step S4 is implemented.

Then, the control unit 1 waits until the recording medium 31 is detected and the reversal and ejection detection unit 4 indicates ON ("NO" in step S6). If the reversal and ejection detection unit 4 indicates ON ("YES" in step S6), the process is moved to step S7, in which the control unit 1 switches the path switching unit 3 at the switching timing set in step S4.

The control unit 1 repeats the processes of steps S6 to S8 until the whole of the recording process executed based on one piece of job information notified in step S1 is terminated ("NO" in step S8).

Then, the control unit 1 determines in step S9 whether or not the jobs are terminated based on all of pieces of notified job information. If the jobs are determined not to be terminated ("NO" in step S9), the process is returned to step S1, in which the control unit 1 repeats the above described processes. Or, if the control unit 1 determines that the jobs are terminated based on all of pieces of job information ("YES" in step S9), the operational process is terminated.

As described above, according to the first preferred embodiment of the present invention, the page gap is shortened based on information for setting a page gap, which is made to correspond to the job information (the type specification information, the size specification information, and the orientation specification information of a recording medium 31) notified from the host apparatus 33, and on the switching timing of the path switching unit 3, whereby the throughput of the continuous recording process can be improved.

A medium conveyance method executed by an image recording apparatus according to a second preferred embodiment is described next with reference to FIG. 11.

The image recording apparatus 32 according to the second preferred embodiment fundamentally has the same configuration as the first preferred embodiment, and only its operational process is different from the first preferred embodiment.

Accordingly, an operational process portion, which is different from the first preferred embodiment, of the image recording apparatus 32 according to the second preferred embodiment is described.

Figure 11:
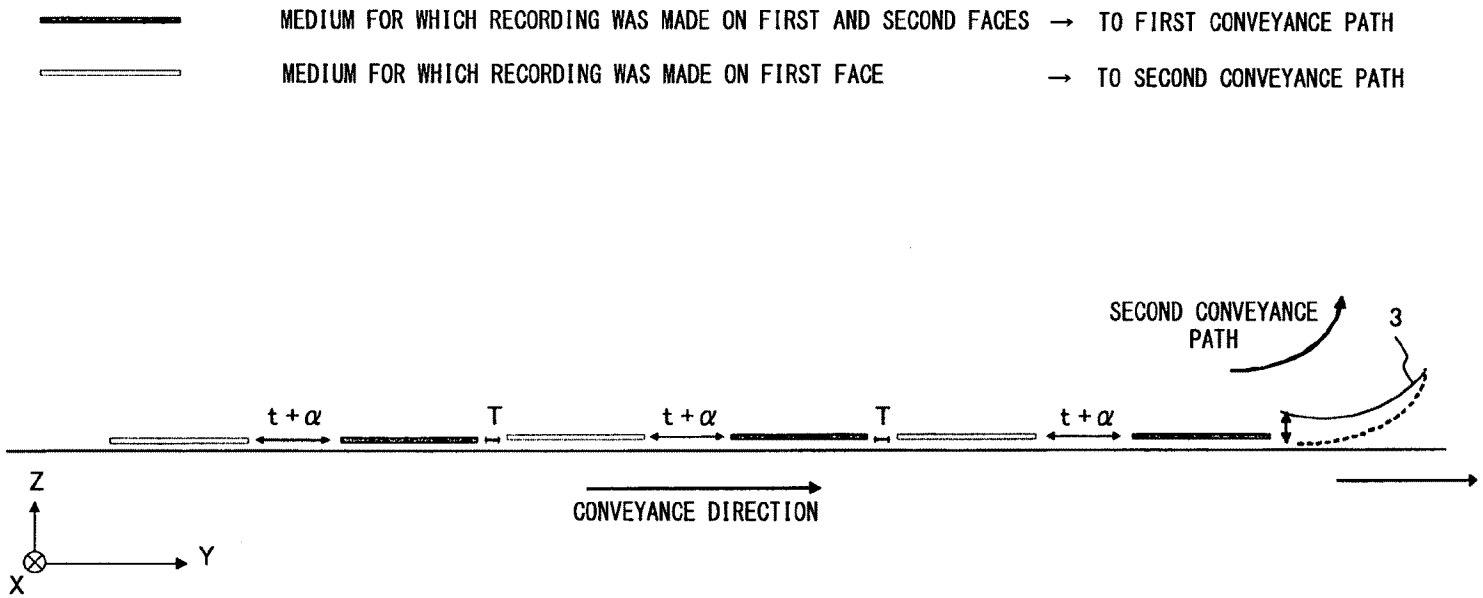
FIG. 11 is a diagram explaining a recording medium conveyance method executed by an image recording apparatus according to a second preferred embodiment.

In the image recording apparatus 32 according to the second preferred embodiment, recording medium 31 are conveyed by setting a page gap at the rear edge of a recording medium 31, for which a recording process has been executed on its first and second faces, to the first defined page gap t+α as shown in FIG. 11, even for the recording medium 31 that are conveyable with the second defined page gap T.

The above described image recording apparatus 32 according to the first preferred embodiment assumes the case where an ink used in the recoding process has a quickly drying nature, or the case where a distance (time) sufficient to make an ink established on the conveyance path of a recording medium is secured.

In contrast, the image recording apparatus 32 according to the second preferred embodiment assumes a case where an ink used in the recording process does not have a quickly drying nature, or a case where a distance (time) sufficient to make an ink established on the conveyance path of a recording medium is not secured (a case where the sufficient distance is not secured with the second defined page gap T).

In the image recording apparatus 32 according to the second preferred embodiment, recording medium 31 are conveyed by setting the page gap at the rear edge of a recording medium 31, for which the recording process has been executed on its first and second faces, to the first defined page gap t+α in order to prevent the path switching unit 3 from slidingly contacting the face of the recording medium 31, on which the recording process has been executed. Additionally, in the image recording apparatus 32 according to the second preferred embodiment, recording medium 31 are conveyed by setting the page gap at the rear edge of a recording medium 31, for which the recording process has been executed on its first face, to the second defined page gap T, thereby improving the throughput of the recording process at the time of both-side continuous recording, or at the time of both-side/one-side continuous recording.

The operational process of the image recording apparatus 32 according to the second preferred embodiment is implemented by setting the page gap at the rear edge of the recording medium 31, for which the recording process has been executed on its first and second faces, to the first defined page gap t+α in step S4 of the above described flowchart shown in FIG. 10.

As described above, according to the second preferred embodiment of the present invention, the page gap is shortened based on information for setting a page gap, which is made to correspond to the job information (the type specification information, the size specification information, and the orientation specification information of a recording medium 31) notified from the host apparatus 33, and on the switching timing of the path switching unit 3, whereby the throughput of the continuous recording process can be improved.

Additionally, according to the second preferred embodiment of the present invention, the page gap at the rear edge of the recording medium 31, for which the recording process has been executed on its first and second faces, to the first defined page gap t+α, and the path switching unit 3 is prevented from slidingly contacting the recording face of the recording medium 31 in the case where an ink used in the recording process does not have a quickly drying nature, or in the case where a distance (time) sufficient to make an ink established on the conveyance path of a recording medium is not secured. As a result, image quality can be prevented from being degraded by sliding contact.

The present invention can embody various types of inventions by appropriately combining the plurality of constituent elements disclosed in the first and the second preferred embodiments. For example, some constituent elements may be removed from the entire configurations disclosed in the first and the second preferred embodiments, or constituent elements of different preferred embodiments may be appropriately combined.

Additionally, for example, the method for driving the path switching unit 3 may be implemented as an operational process for making switching in stages in preparation for the path switching of a succeeding recording medium 31.

Furthermore, the image recording apparatuses 32 according to the first and the second preferred embodiments of the present invention are referred to as image recording apparatuses 32 that comprise the plurality of nozzle arrays (recording heads) 14-1-1 to 14-n-m, and support color recording. However, the image recording apparatuses 32 according to the first and the second preferred embodiments of the present invention are not limited to these apparatuses. The image recording apparatuses 32 may be image recording apparatuses that make single-color recording.

Still further, the image recording apparatuses 32 according to the first and the second preferred embodiments of the present invention are configured to include information indicating the type of a recording medium 31 within job information provided from the host apparatus 33. However, the job information may be implemented simply as information specifying the storage cassettes 29-1 to 29-k, and the type of a recording medium 31 may be identified from this information on the side of the image recording apparatuses 32.

Still further, the image recording apparatuses 32 according to the first and the second preferred embodiments may have a configuration where one storage cassette 29 is comprised, and information indicating the type of a recording medium 31 is preset in the control unit 1 of the image recording apparatuses 32.

Still further, the image recording apparatuses 32 according to the first and the second preferred embodiments of the present invention may have a configuration where a detection unit for detecting the type of a recording medium 31 is further comprised, and a page gap is set based on a result of detection made by the detection unit.

What is claimed is:

1. An image recording apparatus for executing a recording process on at least one of a recording medium fed from a feeding unit and a recording medium on which the recording process has been executed and which is re-fed by reversing the recording medium for a both-side recording process at least via a path switching unit after the recording process, the image recording apparatus comprising:

a driving control unit which determines a page gap to be formed between a preceding and a succeeding recording medium on a conveyance path with respect to at least one of the recording medium fed from the feeding unit and the recording medium on which the recording process has been executed and which is re-fed via the path switching unit after the recording process, the determination being made at least based on information indicating whether or not a recording medium on the path switching unit when the path switching unit switches the recording medium to a re-feeding side floats from a conveyance face of the conveyance path at an end of an upstream side of the conveyance direction.

2. The image recording apparatus according to claim 1, wherein the driving control unit determines the page gap in accordance with information specifying a mode of the recording process as job information, respectively in a case where the preceding recording medium is ejected after a one-side recording process and the succeeding recording medium is ejected after the one-side recording process, a case where the preceding recording medium is ejected after the one-side recording process and the succeeding recording medium is re-fed for the both-side recording process, a case where the preceding recording medium, for which the both-side recording process has been executed, is ejected and the succeeding recording medium is ejected after the one-side recording process, and a case where the preceding recording medium is re-fed for the both-side recording process and also the succeeding recording medium is re-fed for the both-side recording process.

3. A recording medium conveyance method executed by an image recording apparatus for executing a recording process on at least one of a recording medium fed from a feeding unit and a recording medium on which the recording process has been executed and which is re-fed by reversing the recording medium for a both-side recording process at least via a path switching unit after the recording process, the recording medium conveyance method comprising:

determining a page gap to be formed between a preceding and a succeeding recording medium on a conveyance path with respect to at least one of the recording medium fed from the feeding unit and the recording medium on which the recording process has been executed and which is re-fed via the path switching unit after the recording process, the determination being made at least based on information indicating whether or not a recording medium on the path switching unit when the path switching unit switches the recording medium to a re-feeding side floats from a conveyance face of the conveyance path at an end of an upstream side of the conveyance direction; and conveying the preceding recording medium and the succeeding recording medium based on the determined page gap.

4. The recording medium conveyance method according to claim 3, wherein the page gap is determined in accordance with information specifying a mode of the recording process as job information, respectively in a case where the preceding recording medium is ejected after a one-side recording process and the succeeding recording medium is ejected after the one-side recording process, a case where the preceding recording medium is ejected after the one-side recording process and the succeeding recording medium is re-fed for the both-side recording process, a case where the preceding recording medium, for which the both-side recording process has been executed, is ejected and the succeeding recording medium is ejected after the one-side recording process, and a case where the preceding recording medium is re-fed for the both-side recording process and also the succeeding recording medium is re-fed for the both-side recording process.

5. An image recording apparatus for executing a recording process on at least one of a recording medium fed from a feeding unit and a recording medium on which the recording process has been executed and which is re-fed by reversing the recording medium for a both-side recording process at least via a path switching unit after the recording process, the image recording apparatus comprising:

a driving control unit which determines a page gap to be formed between a preceding and a succeeding recording medium on a conveyance path with respect to at least one of the recording medium fed from the feeding unit and the recording medium on which the recording process has been executed and which is re-fed via the path switching unit after the recording process, the determination being made at least based on hardness information of the recording medium.

6. The image recording apparatus according to claim 5, wherein the driving control unit determines the page gap in accordance with information specifying a mode of the recording process as job information, respectively in a case where the preceding recording medium is ejected after a one-side recording process and the succeeding recording medium is ejected after the one-side recording process, a case where the preceding recording medium is ejected after the one-side recording process and the succeeding recording medium is re-fed for the both-side recording process, a case where the preceding recording medium, for which the both-side recording process has been executed, is ejected and the succeeding recording medium is ejected after the one-side recording process, and a case where the preceding recording medium is re-fed for the both-side recording process and also the succeeding recording medium is re-fed for the both-side recording process.

7. A recording medium conveyance method executed by an image recording apparatus for executing a recording process on at least one of a recording medium fed from a feeding unit and a recording medium on which the recording process has been executed and which is re-fed by reversing the recording medium for a both-side recording process at least via a path switching unit after the recording process, the recording medium conveyance method comprising:

determining a page gap to be formed between a preceding and a succeeding recording medium on a conveyance path with respect to at least one of the recording medium fed from the feeding unit and the recording medium on which the recording process has been executed and which is re-fed via the path switching unit after the recording process, the determination being made at least based on hardness information of the recording medium; and conveying the preceding recording medium and the succeeding recording medium based on the determined page gap.

8. The recording medium conveyance method according to claim 7, wherein the page gap is determined in accordance with information specifying a mode of the recording process as job information, respectively in a case where the preceding recording medium is ejected after a one-side recording process and the succeeding recording medium is ejected after the one-side recording process, a case where the preceding recording medium is ejected after the one-side recording process and the succeeding recording medium is re-fed for the both-side recording process, a case where the preceding recording medium, for which the both-side recording process has been executed, is ejected and the succeeding recording medium is ejected after the one-side recording process, and a case where the preceding recording medium is re-fed for the both-side recording process and also the succeeding recording medium is re-fed for the both-side recording process.

* * * * *